US008166951B2

(12) United States Patent
Takahashi et al.

(10) Patent No.: US 8,166,951 B2
(45) Date of Patent: May 1, 2012

(54) ENGINE

(75) Inventors: Takeshi Takahashi, Osaka (JP); Tooru Yoshizuka, Osaka (JP); Yukihiro Shinohara, Aichi (JP); Keiji Ooshima, Aichi (JP); Toshiro Itatsu, Aichi (JP)

(73) Assignee: Yanmar Co., Ltd., Osaka-shi (JP)

( * ) Notice: Subject to any disclaimer, the term of this patent is extended or adjusted under 35 U.S.C. 154(b) by 595 days.

(21) Appl. No.: 12/300,394

(22) PCT Filed: Apr. 19, 2007

(86) PCT No.: PCT/JP2007/058539

§ 371 (c)(1),
(2), (4) Date: Apr. 23, 2009

(87) PCT Pub. No.: WO2007/132633

PCT Pub. Date: Nov. 22, 2007

(65) Prior Publication Data

US 2010/0006077 A1 Jan. 14, 2010

(30) Foreign Application Priority Data

May 11, 2006 (JP) ..... 2006-132603

(51) Int. Cl.
*F02D 41/04* (2006.01)

(52) U.S. Cl. ..... 123/436; 123/406.65; 73/114.04; 73/114.11

(58) Field of Classification Search ..... 123/406.58, 123/406.6, 406.64, 406.65, 436; 73/114.04, 73/114.11, 114.15, 114.22
See application file for complete search history.

(56) References Cited

U.S. PATENT DOCUMENTS

| | | | | | |
|---|---|---|---|---|---|
| 4,496,286 | A | * | 1/1985 | Gagnon | 417/22 |
| 4,843,870 | A | * | 7/1989 | Citron et al. | 73/114.15 |
| 4,932,379 | A | * | 6/1990 | Tang et al. | 123/436 |
| 5,269,178 | A | * | 12/1993 | Vigmostad et al. | 73/114.15 |
| 5,309,756 | A | * | 5/1994 | Osawa et al. | 73/114.04 |
| 5,436,556 | A | * | 7/1995 | Komninos | 324/76.23 |
| 5,515,281 | A | * | 5/1996 | Palazzetti et al. | 701/111 |
| 5,686,672 | A | * | 11/1997 | Klauber et al. | 73/862.191 |
| 5,744,722 | A | * | 4/1998 | Wu et al. | 73/659 |
| 5,869,752 | A | * | 2/1999 | Klauber et al. | 73/114.15 |
| 6,212,945 | B1 | * | 4/2001 | Moskwa | 73/114.15 |
| 2002/0007670 | A1 | * | 1/2002 | Sano | 73/117.3 |

FOREIGN PATENT DOCUMENTS

| | | | |
|---|---|---|---|
| JP | H09-273444 | A | 10/1997 |
| JP | H09-324674 | A | 12/1997 |
| JP | 2003-328850 | A | 11/2003 |
| JP | 2004-108160 | A | 4/2004 |

OTHER PUBLICATIONS

International Search Report mailed on May 15, 2007, for International Application No. PCT/JP2007/58539 filed on Apr. 19, 2007, 1 pg.

* cited by examiner

*Primary Examiner* — Erick Solis
(74) *Attorney, Agent, or Firm* — Sterne, Kessler, Goldstein & Fox P.L.L.C.

(57) ABSTRACT

An engine includes an angular velocity detecting means 10 for detecting a rotation angular velocity of a crankshaft 11 of the engine, a torque generated by the engine detecting means for detecting a variability of the angular velocity amplitude obtained by the angular velocity detecting means 10 as the variability of the torque generated by the engine. The engine compensates a fuel injection quantity by comparing the angular velocity amplitude detected by the angular velocity detecting means with the adequate angular velocity amplitude.

21 Claims, 11 Drawing Sheets an injection quantity Q

| acceleration gate opening A | | | | | | | | |
|---|---|---|---|---|---|---|---|---|
| An | Q1n | · · · | · | · · · | Qmn |
| · | · | | | · | · |
| · | · | | | · | · |
| · | · | | | · | · |
| · | · | | · | | · |
| · | · | | · | | · |
| · | · | | | | · |
| · | · | · | | | · |
| · | · | | | | · |
| A3 | Q13 | | | | · |
| A2 | Q12 | Q22 | | | · |
| A1 | Q11 | Q21 Q31 · | · | · · · · | Qm1 |
| | r1 | r2 r3 · | · | · · · · | rm |

Engine rotation numbers r

80

FIG. 5 assumed angular velocity amplitude ωL

| injection quantity Q | r1 | r2 | r3 | · | · | · | · | · | rm |
|---|---|---|---|---|---|---|---|---|---|
| Qn | ωL1n | · | · | · | · | · | · | · | ωLmn |
| · | · | | | | | | | · | · |
| · | · | | | | | | · | | · |
| · | · | | | | | · | | | · |
| · | · | | | | · | | | | · |
| · | · | | | · | | | | | · |
| · | · | | · | | | | | | · |
| · | · | · | | | | | | | · |
| · | · | | | | | | | | · |
| Q3 | ωL13 | | | | | | | | · |
| Q2 | ωL12 | ωL22 | | | | | | | · |
| Q1 | ωL11 | ωL21 | ωL31 | · | · | · | · | · | ωLm1 |

Engine rotation numbers r

90

FIG. 6

ENGINE

BACKGROUND OF THE INVENTION

1. Field of the Invention

The present invention relates to a technique for detecting angular velocity amplitude of an engine rotation proportional to a torque generated by an engine and compensating an amount of fuel consumption.

2. Related Art

Conventionally, in an injection quantity control of the engine, various sensors (for an exhaust gas temperature, an air flow or the like) were used for OBD (a failure in the exhaust gas controlling device). The compensation of the injection quantity for time degradation of the engine can be performed at only a limited case such as during an idling of the engine.

For example, JP2004-108160 discloses an engine that corrects variations in the respective cylinder engines as well as that realizes an adequate fuel injection and a valve-opening operation during normal operation except the idling.

SUMMARY OF THE INVENTION

However, the amount of fuel consumption must be adequate to an actual torque. Conventionally, there was no device for detecting the torque generated by the engine during the engine operation except installing a special measuring device regardless of whether the engine was a gasoline or a diesel engine.

Accordingly, wastes are accrued, such as temporal changes of a declared power or wasted slippages deteriorated as measuring exhaust gas deteriorated values on a commercial basis and on the exhaust gas measure.

Especially, in a construction so as to control an actual injection quantity as represented by a common-rail fuel injection system, the initially-established injection quantity and the actual injection quantity are dissociated, thereby causing the problems such as the performance shift, because of the temporal change, such as wasting of machine components such as a pump, an injector and a nozzle, or an adherence of carbon. To solve these problems, the increasein cost incurred, for example by attachment of a smoke sensor for feedback are major issues.

Consequently, the problem to be solved is to prevent the performance shift of the engine by detecting the torque generated by the engine and by performing the adequate fuel injection using the torque generated by the engine.

The problem to be solved by the present invention is as mentioned above. A means so as to solve the problem will be described.

An engine torque detection means of the present invention comprises an angular velocity detecting means for detecting a rotation angular velocity of a crankshaft of an engine, said angular velocity detecting means detecting a variability of angular velocity amplitude obtained by the angular velocity detecting means as the variability of the torque generated by the engine.

In the present invention, the angular velocity amplitude is a relative angular velocity amplitude to an average angular velocity or the absolute valueof the angular velocity amplitude.

In the present invention, the angular velocity amplitude is only a larger angular velocity amplitude than the average angular velocity.

In the present invention, the angular velocity amplitude is an angular velocity amplitude of the engine rotation toward the angle of the engine rotation, or the angular velocity amplitude of the engine rotation with respect to time.

An engine of the present invention comprises a load detecting means for detecting an engine load, a rotation number detecting means for detecting the engine rotation number; an injection quantity map for calculating the fuel injection quantity based on the load by the load detecting means and the rotation number by the rotation number detecting means, an angular velocity amplitude map that represents an assumed angular velocity amplitude that is defined by the rotation number detected by the rotation number detecting means and by the injection quantity calculated using the injection quantity map, and an injection quantity compensation means for compensating the injection quantity map by comparing the angular velocity amplitude detected by the engine torque detection means with the assumed angular velocity amplitude determined using the angular velocity amplitude map.

The engine of the present invention comprises a cylinder difference torque compensating means including a plurality of cylinders, the angular velocity detecting means and the injection map in the respective cylinders, wherein the cylinder difference torque compensating means compensates the injection quantity map of the other cylinders so as to conform the angular velocity amplitude detected by the angular velocity detecting means of one cylinder to the angular velocity amplitude detected by the angular velocity detecting means of the other cylinder.

The engine of the present invention comprises an exhaust gas temperature detecting means for detecting the exhaust gas temperature, an injection quantity compensation value confirming means, wherein it evaluates that the injection quantity map compensated by the injection quantity compensation means or by the cylinder difference torque compensation means is normal if the exhaust gas temperature detected by the exhaust gas temperature detecting means is within the prescribed area, and it evaluates that the injection quantity map is abnormal if the exhaust gas temperature is beyond the prescribed area.

The engine of the present invention comprises a supercharging device, a supercharging device pressure detecting means for detecting the supercharging device pressure of the supercharging device and an injection quantity compensation value conforming means, wherein it evaluates that the injection quantity map compensated by the injection quantity compensation means or by the cylinder difference torque compensation means is normal if the supercharging device pressure detected by the supercharging device pressure detecting means is within the prescribed area, and it evaluates that the injection quantity map is abnormal if the supercharging device pressure is beyond the prescribed area.

The engine of the present invention comprises a supercharging device, a turbo rotation number detecting means for detecting the rotation number of the turbine of the supercharging device and an injection quantity compensation value conforming means, wherein it evaluates that the injection quantity map compensated by the injection quantity compensation means or by the cylinder difference torque compensation means is normal if the turbo rotation number detected by the turbo rotation number detecting means is within the prescribed area, and it evaluates that the injection quantity map is abnormal if the supercharging device pressure is beyond the prescribed area.

The engine of the present invention comprises a warning means, wherein it issues a warning to an operator if the injection quantity map is compensated by the injection quantity compensation means or by the cylinder difference torque compensation means, or if injection quantity compensation value conforming means evaluates that the injection quantity map is abnormal.

The engine of the present invention comprises a compensation canceling means, wherein it cancels the injection quantity compensation means by the manipulation of the operator.

The engine of the present invention comprises the compensation canceling means, wherein the compensation of the injection quantity map by the injection quantity compensation means or by the cylinder difference torque compensation means can be canceled by the manipulation of the operator.

The present invention shows the following effects.

In the present invention, the angular velocity amplitude of the engine rotation is proportional to the torque generated by the engine, thereby easily, detecting the actual torque generated by the engine in real time with a simple construction.

Also, in the present invention, in case of the engine including a plurality of cylinder engines, cylinder engines can be compared with the angular velocity amplitudes thereof to each other, thereby improving a general versatility while measuring and calculating the angular velocity amplitudes.

Further, in the present invention, a stable amplitude having low detonating change impact on the bottom dead center can be achieved, thereby detecting more precisely the torque generated by the engine.

In the present invention, the angular velocity amplitudes can be easily measured.

In the present invention, the fuel can be adequately injected regardless of the temporal change of the equipments, thereby preventing the performance degradation of the engine and achieving an efficient, stable traveling.

In the present invention, the respective cylinder engine differences by the torque reaction force can be reduced, thereby minimizing a vibration by the ignition of the engine.

In the present invention, a reliability of the compensation for the injection quantity can be improved by confirming an exhaust gas temperature after the compensation for the injection quantity.

In the present invention, the reliability of the compensation for the injection quantity can be improved by confirming a boost pressure after the compensation for the injection quantity.

In the present invention, the reliability of the compensation for the injection quantity can be improved by confirming turbo rotation number after the compensation for the injection quantity.

In the present invention, an operator can recognize that the injection quantity is compensated and that the injection quantity is adequately compensated, so that an operability of the engine can be improved.

In the present invention, an operator can cancel the compensation for the injection quantity, so that the operability of the engine can be improved.

BRIEF DESCRIPTION OF THE DRAWINGS

FIG. 5 is a mapping diagram showing an amount of fuel consumption calculated by the engine rotating numbers and an acceleration gate opening.

FIG. 6 is a mapping diagram showing an engine rotation angular velocity amplitude derived by the engine rotating numbers and the amount of fuel consumption.

DETAILED DESCRIPTION OF THE INVENTION

An embodiment of the invention will be described.

Figure 1:
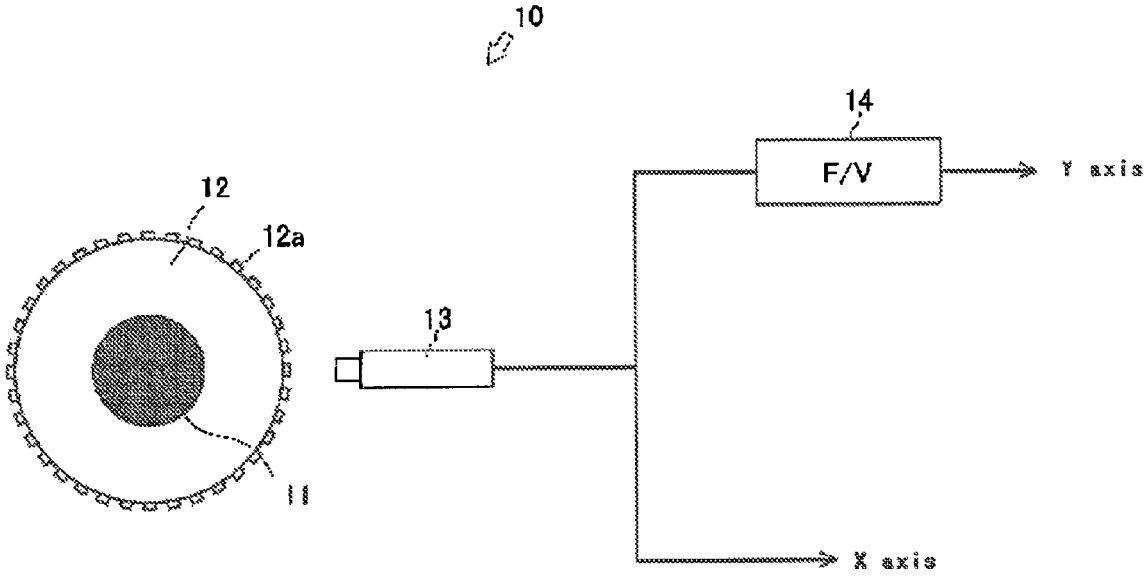
FIG. 1 is a diagram showing a construction of an angular velocity sensor according to the present invention.
Figure 2:
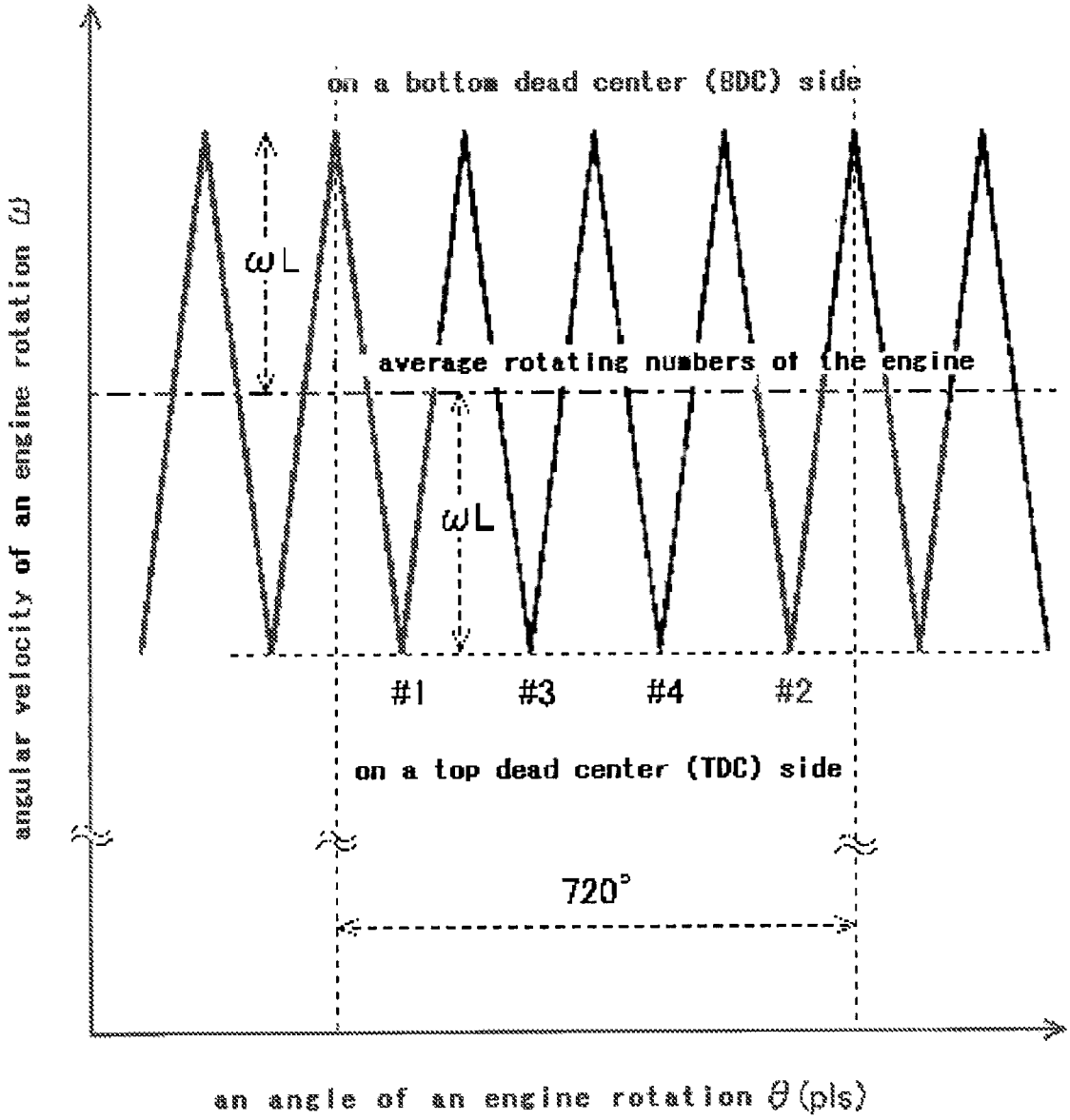
FIG. 2 is a graph chart of the angular velocity of an engine rotation toward the angle of the engine rotation.
Figure 3:
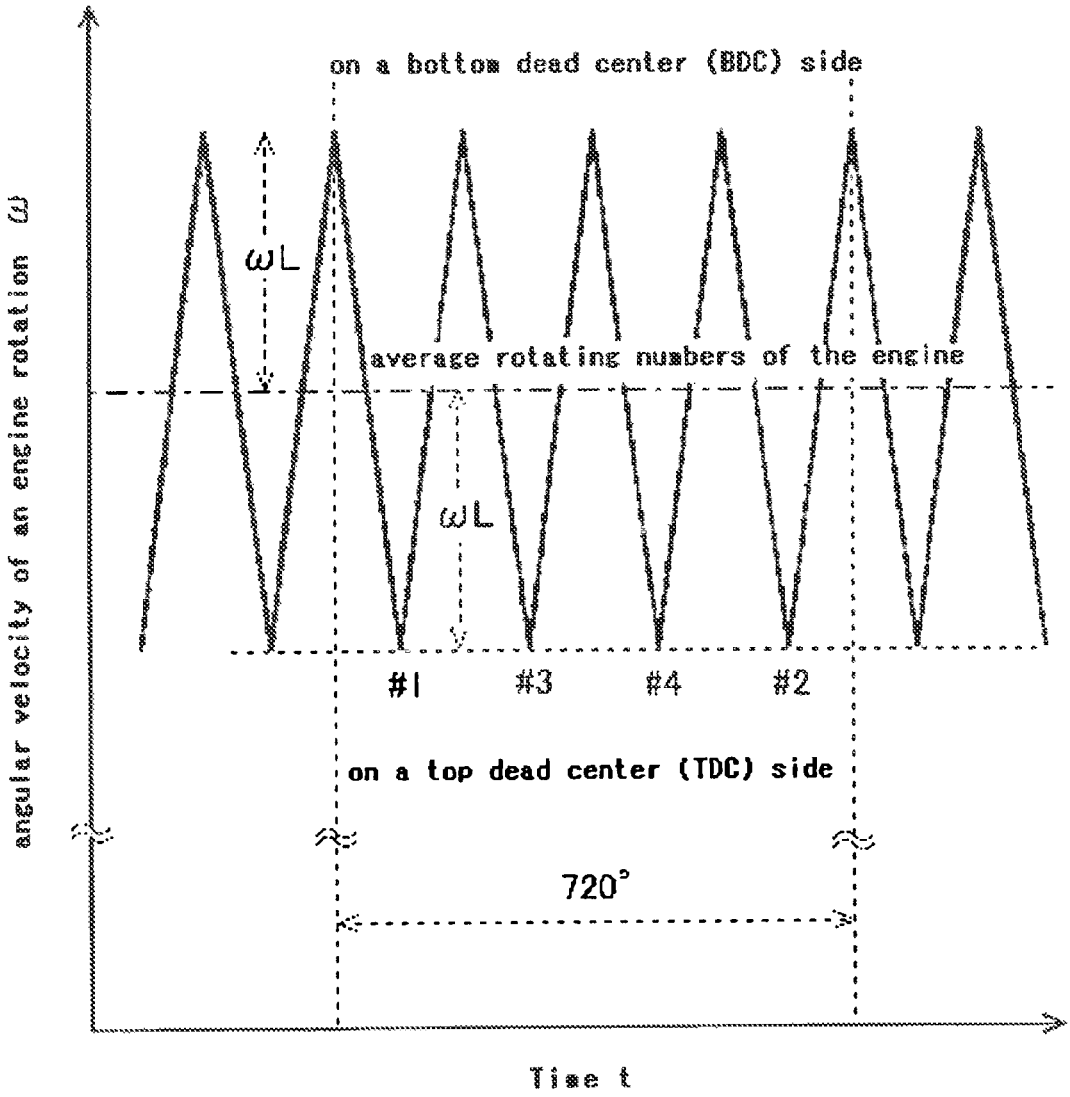
FIG. 3 is a graph chart of a temporal change in the angular velocity of the engine rotation
Figure 4:
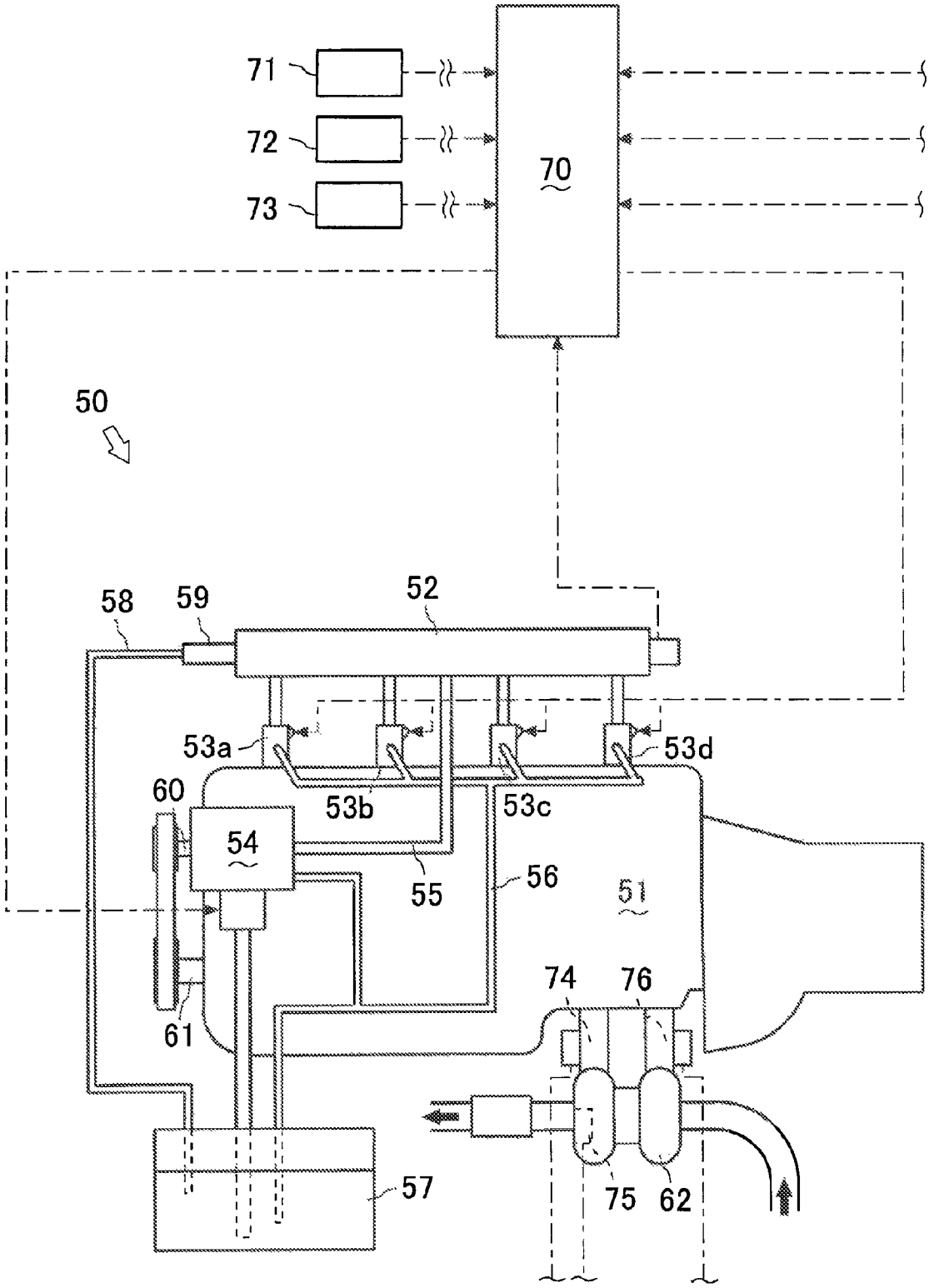
FIG. 4 is a diagram showing a construction of a common-rail fuel injection system according to an embodiment of the present invention.

FIG. 1 is a diagram showing a construction of an angular velocity sensor according to the present invention. FIG. 2 is a graph chart of the angular velocity of an engine rotation toward the angle of the engine rotation. FIG. 3 is a graph chart of a temporal change in the angular velocity of an engine rotation FIG. 4 is a diagram showing a construction of a common-rail fuel injection system according to an embodiment of the present invention. FIG. 5 is a mapping diagram showing an amount of fuel consumption calculated by the engine rotating numbers and an acceleration gate opening FIG. 6 is a mapping diagram showing an engine rotation angular velocity amplitude derived by the engine rotating numbers and the amount of fuel consumption.

Figure 7:
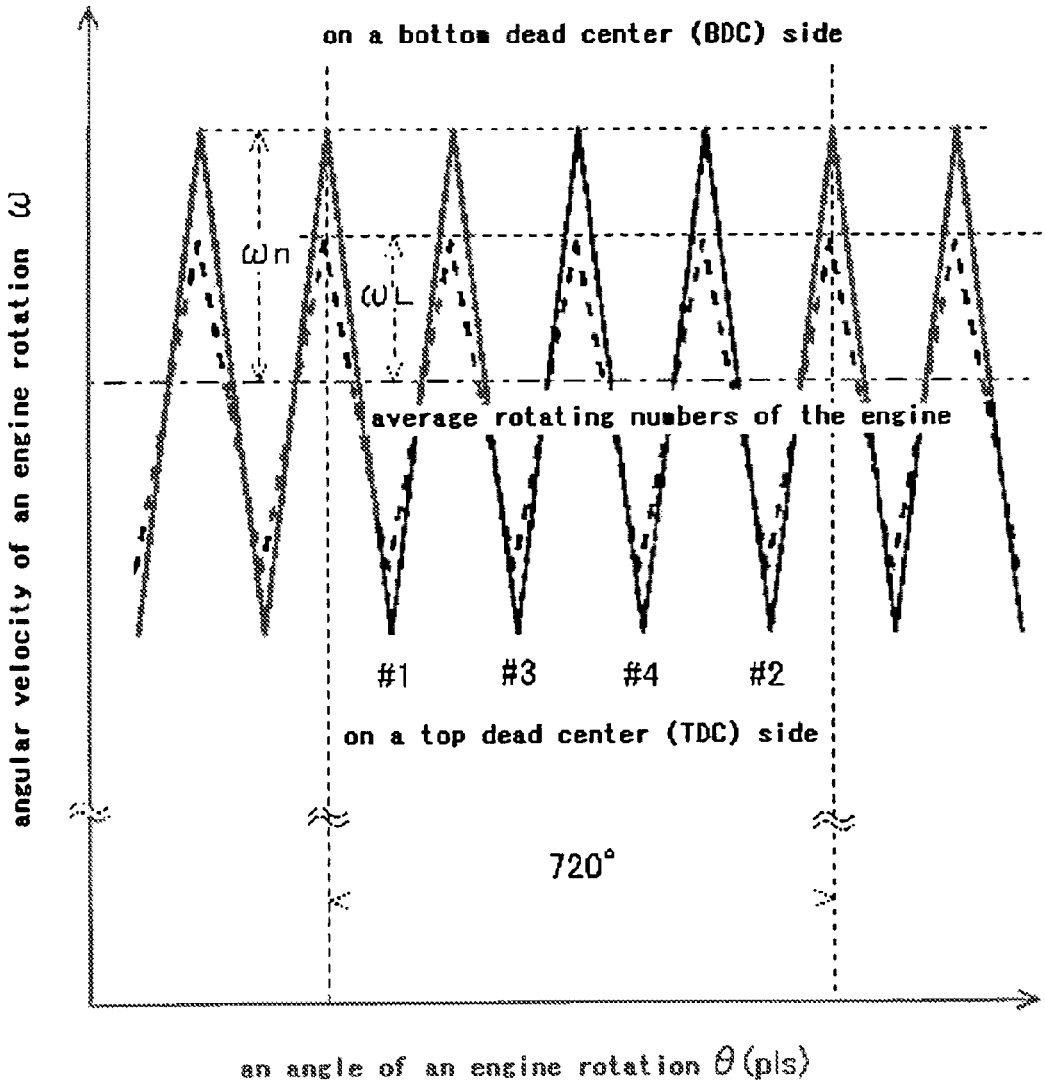
FIG. 7 is a graph chart showing the engine rotating angular velocity with the increasing torque.
Figure 8:
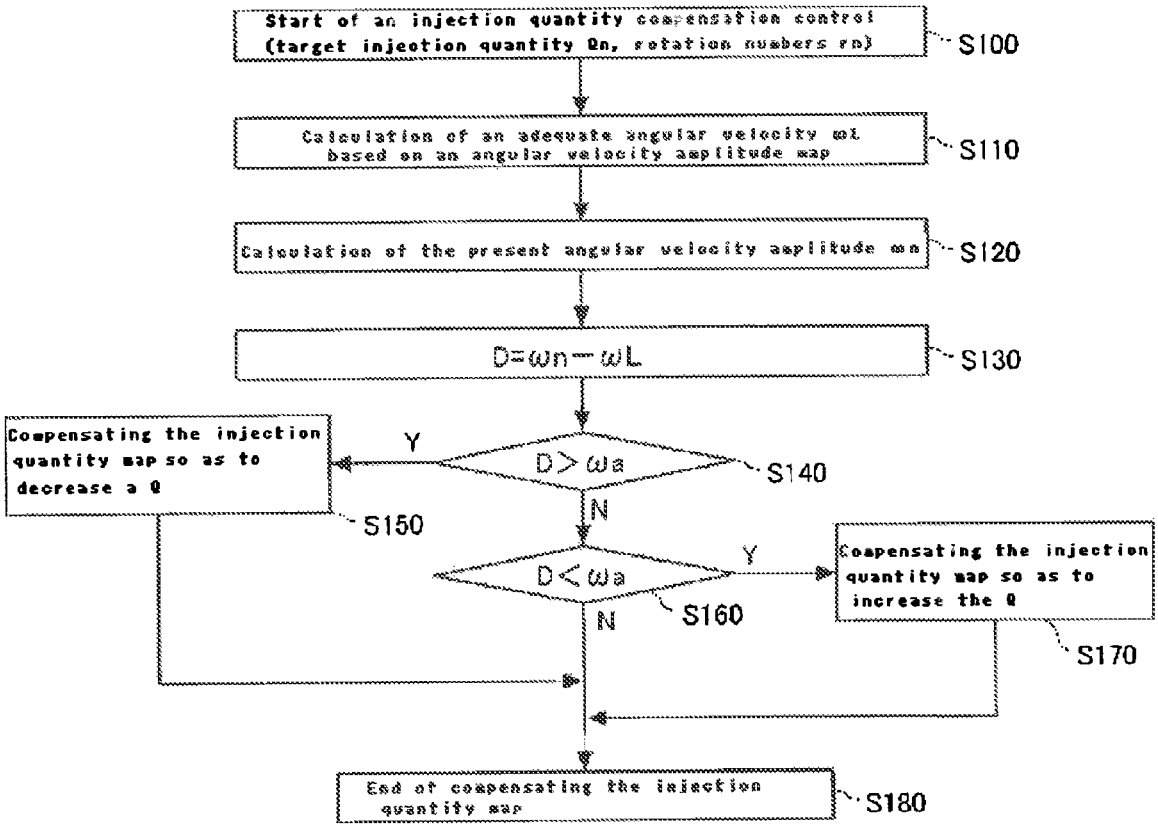
FIG. 8 is a flow diagram of an injection quantity compensation control.
Figure 9:
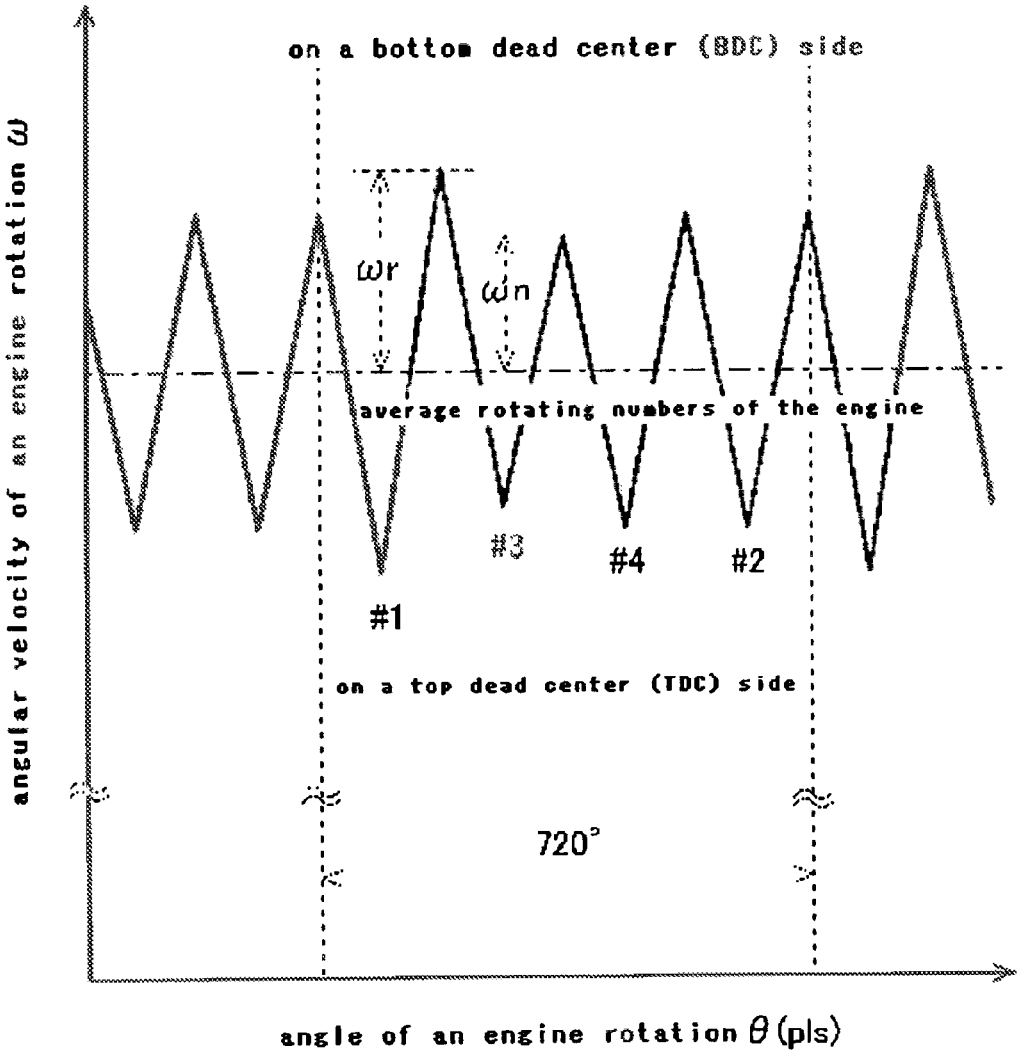
FIG. 9 is a graph chart showing the engine rotating angular velocity with variations of the torques in the cylinder engine differences.

FIG. 7 is a graph chart showing the engine rotating angular velocity with increasing torque. FIG. 8 is a flow diagram of an injection quantity compensation control. FIG. 9 is a graph chart showing the engine rotating angular velocity with variations of the torques in the cylinder engine differences.

Figure 10:
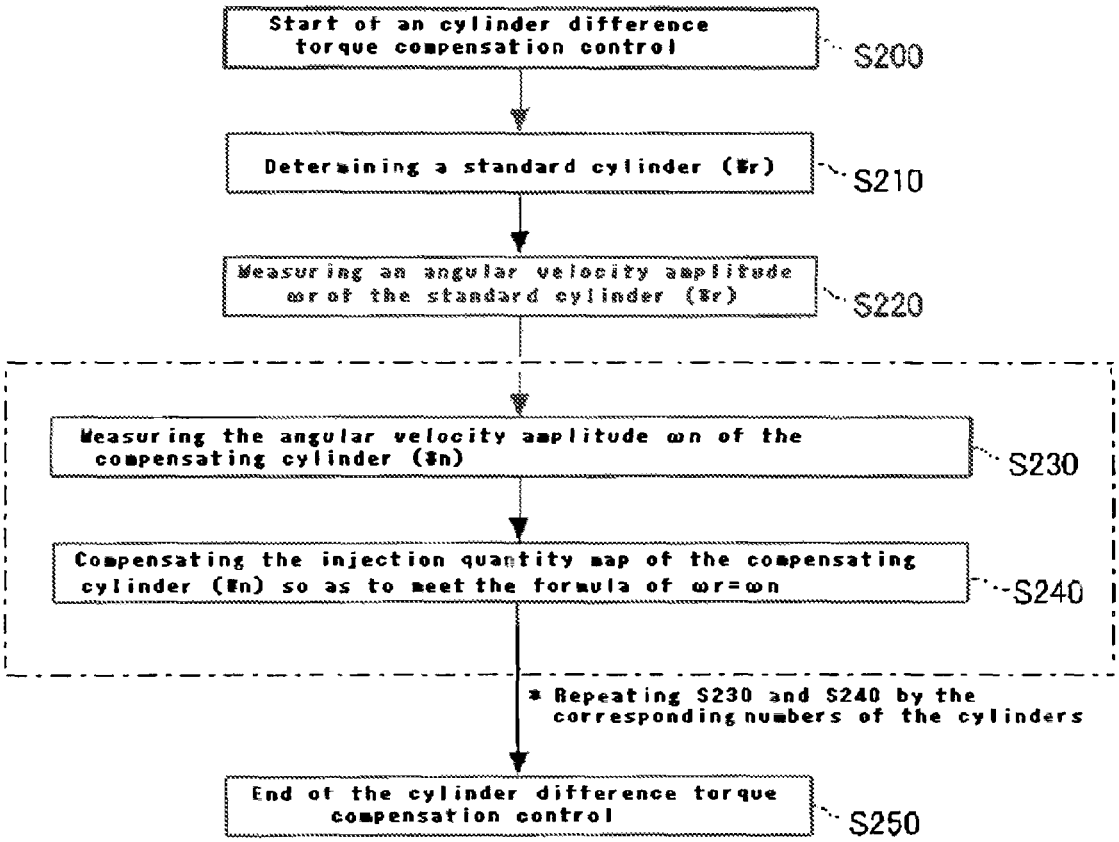
FIG. 10 is a flow diagram of a cylinder engine difference torque compensation control.

FIG. 10 is a flow diagram of a cylinder engine difference torque compensation control.

Figure 11:
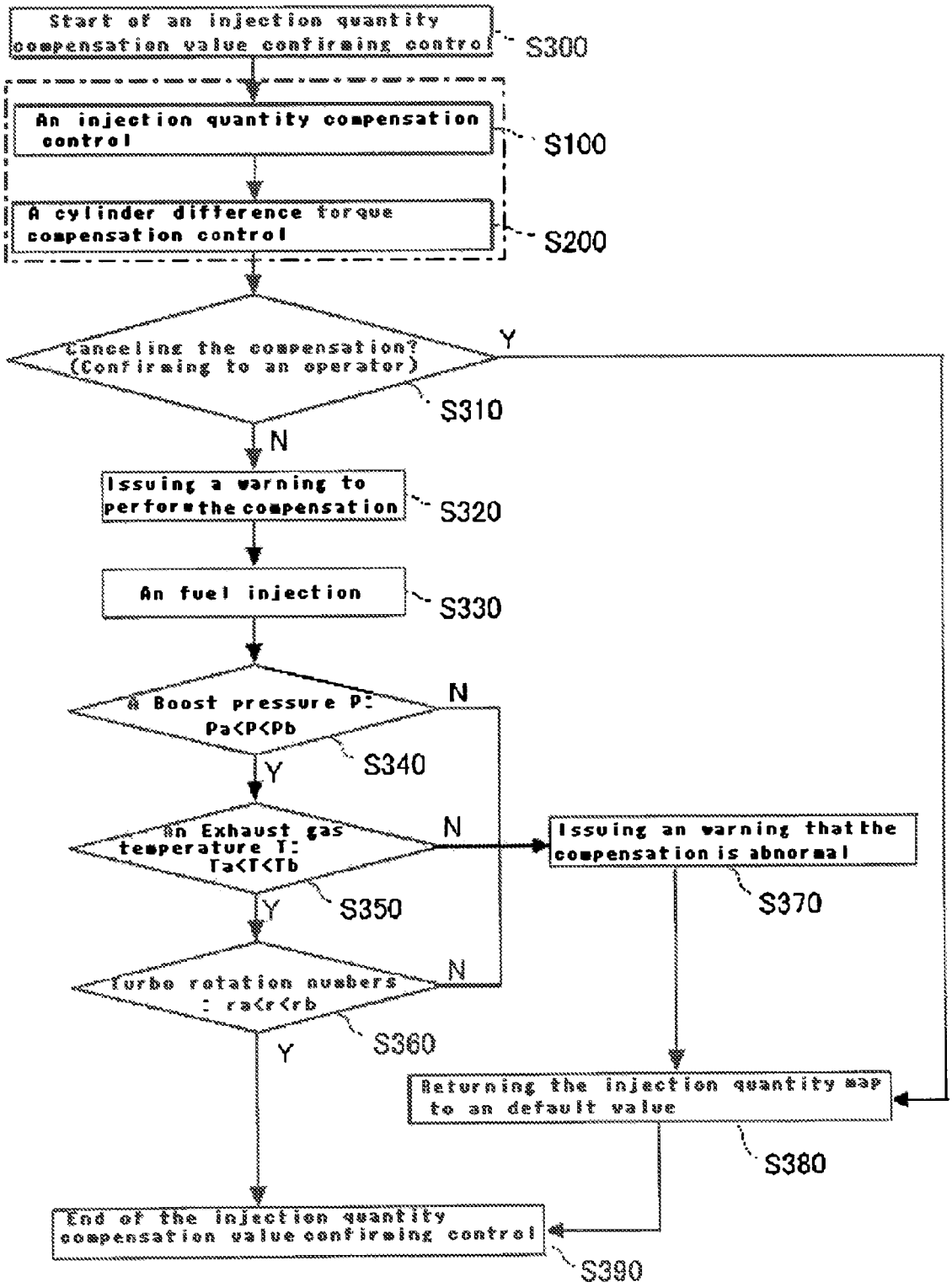
FIG. 11 is a flow diagram of an injection quantity compensation confirming control.

FIG. 11 is a flow diagram of an injection quantity compensation confirming control.

An angular velocity amplitude of an engine rotation serving as a key component of the present invention will be described. A feature of the present invention is to detect a torque generated by the engine that has not been heretofore measured, using the angular velocity amplitude of the engine rotation. At first, the angular velocity amplitude of the engine rotation will be described in detail and, next, the torque detecting device using the angular velocity amplitude of the engine rotation will be described. Further, an injection quantity compensation control and a cylinder engine difference torque compensating device in a common rail fuel injection system, with the torque detecting device, will be described.

Referring to FIG. 1, the angular velocity sensor for measuring the angular velocity of the engine rotation will be described in detail.

As shown in FIG. 1, an angular velocity sensor 10 is a sensor for detecting two signals using a pulse sensor 13. A pulsar 12 is integrally and rotatably fixed on a crankshaft 11 of the engine (not shown). Teeth (pulses) 12*a* are formed at specified intervals around the pulsar 12. A gear may be used as the pulsar 12 and a circular plate that pores or slits are provided per given angles or the like may be used as the pulsar 12. The pulse sensor 13 can be composed of an adjacent sensor, a magnetic sensor and an optical sensor (a photointerruptor) or the like. The angular velocity sensor 10 is provided perpendicular to the crankshaft 11. The angular velocity sensor 10 can measure the pulses 12*a* output from the pulsar 12. The signal from the angular velocity sensor 10 is branched into two signals, one of which is output as a X axis and the other of which is output as a Y axis through a F/V converter (frequency/voltage converter) 14.

Due to the above construction, the angular velocity sensor 10 outputs the engine rotating numbers, i.e. crank angle θ (the numbers of the pulses 12*a*) to the X axis, regardless of the time and on the other hand, the angular velocity sensor 10 output pulse numbers per hour, i.e. angular velocity ω to the Y axis.

Incidentally, in the present invention, a measuring error observed between two signals is prevented by outputting two signals (the crank angle θ and the crank angular velocity ω) from the angular velocity sensor 10.

Next, referring to FIG. 2, the crank angle θ and the crank angular velocity ω will be described in detail.

FIG. 2 shows the measuring result of above-mentioned angular velocity sensor 10. In other words, the X axis is the crank angle θ and the Y axis is the crank angular velocity ω. As will be understood by FIG. 2, the angular velocity amplitude ω is a wave form amplitude toward the crank angle θ.

The waveform amplitude of FIG. 2 shows a four-cycle, four-cylinder engine that four strokes of explosions is occurring while the crankshaft 11 is rotating twice)(720°). #1 of FIG. 2 shows an explosion point in the first cylinder and #2 shows the explosion point in the second cylinder, respectively.

Further, a chain line at the center of the waveform amplitude shows an average value of the crank angular velocity ω, i.e. an average rotating number of the engine. The returning point above the waveform amplitude shows BDC (the bottom dead center) and the returning point below the waveform amplitude shows TDC (the top dead center). In other words, it would be understood that the crankshaft 11 accelerates the angular velocity from the TDC to the BDC by the explosions and deaccelerates the angular velocity from the BDC to the TDC, thereby, repeating the above-mentioned rotations.

Herein, it is understood that as a load is increasing at the same rotating number, an amplitude ωL of the crank angular velocity ω is increasing, so that the load as well as the amplitude ωL vary in a similar manner, in other words, the load is proportional to the amplitude ωL. More specifically, if the rotating numbers are the same, the crank angle velocity amplitude ωL shows a result value of an instant friction loss, i.e. an actual engine output. In other words, The amplitude ωL of the crank angular velocity ω is proportional to the torque generated by the engine.

Further, the upper side and the lower side of the angular velocity average value in the crank angular velocity ω are separately described. The upper side (BDC side) shows the actual torque generated by the engine as the result value after the explosion.

On the other hand, because the lower side (TDC side) shows an explosion state, the angular velocity amplitude ωL on the lower side (TDC side) is determined by a combustion state. In other words, the lower side (TDC side) of the angular velocity amplitude ωL shows the change of the combustion state varied by the increase and decrease of external factors, for example, a fuel cetane rating.

Because if the engine 100 is rotating in steady rotating numbers, the crank angle shows a constant value against time, the crank angular velocity ω of the crank angle may be represented against time t. In FIG. 3, the X axis is the temporal axis t and the Y axis is a pulse number, i.e. the angular velocity ω.

Thus, because the angular velocity amplitude of the engine rotation is proportional to the torque generated by the engine, the actual torque generated by the engine with the friction loss according to the exploded amount can be detected in real time by measuring the present crank angular velocity amplitude and by comparing it with, for example, the initially-set adequate standard angular velocity amplitude. In this case, the torque generated by the engine can be detected by sensing the upper side of the average rotating numbers on the angular velocity amplitude of the engine rotation.

Since the lower side of the average rotating numbers on the angular velocity amplitude of the engine rotation represents the combustion state, the change of the cetane rating can be detected by measuring the present crank angular velocity amplitude and by comparing it with for example, the standard angular velocity amplitude of the initially-set fuel cetane rating. The injection pressure/injection quantity/injection times are optimally compensated in accordance with the change of the cetane rating, thereby minimizing the performance shift of the engine and the change of the exhaust gas.

Hereinafter, in the four-cycle, four-cylinder diesel engine equipped with the common-rail fuel injection system, a compensation control of the fuel injection using the engine torque detecting device will be described.

Referring to FIG. 4, a construction of a common-rail fuel injection system 50 equipped with the torque detecting device of the present invention will be briefly described.

As shown in FIG. 4, the common-rail fuel injection system 50 is for example, a system for injecting the fuel into the diesel engine 51. More specifically, the common-rail fuel injection system 50 includes a common-rail 52 which accumulates the fuel, injectors 53*a*, 53*b*, 53*c* and 53*d* which inject the fuel into the respective cylinders, a supply pump 54 and an engine control unit (hereinafter, referred to as ECU) 70.

The common-rail 52 is a device which accumulates a high pressure fuel to supply with the injector 53. The common-rail 52 is connected to an outlet of the supply pump 54 that conveys the high pressure fuel through a fuel tubing (a high pressure fuel passage) 55, so as to accumulate a common-rail pressure equivalent to a fuel injection pressure.

A leaked fuel from the injector 53 is restored to a fuel tank 57 through a leak tubing (a fuel reflux passage) 56.

A pressure limiter 59 is attached to a relief tubing (a fuel reflux passage) 58 from the common-rail 52 to the fuel tank 57. The pressure limiter 59 is a pressure safety valve, which is open when the fuel pressure in the common-rail 52 is higher than a delimitation pressure, thereby reducing the fuel pressure in the common-rail 52 up to less than the delimitation pressure.

The injector 53, which is loaded with the respective cylinders of the engine 51, injects and supplies the fuel with the respective cylinders. The injector 53 is connected to the downstream end of a plurality of branch pipes branched from the common rail 52. The injector 53 loads a fuel injection nozzle that injects and supplies the high pressure fuel accumulated in the common-rail 52 with the respective cylinders as well as solenoid valves for lifting control of a needle accommodated in the fuel injection nozzle and or the like.

In the solenoid valve of the injector 53, an injection timing and the injection quantity are controlled by an injector opening valve signal transmitted from the ECU 70. The high pressure fuel is injected and supplied with the cylinder when the injector opening valve signal is transmitted to the solenoid valve, and the fuel injection is stopped when the injector opening valve signal is not transmitted to the solenoid valve.

The supply pump 54 is a fuel pump that conveys the high pressure fuel to the common-rail 52. The supply pump 54 loads a feed pump and a high pressure pump. The feed pump draws the fuel in the fuel tank 57 into the supply pump 54. The high pressure pump compresses the fuel absorbed by the feed pump at a high pressure and conveys it to the common-rail 52. The feed pump and the high pressure pump are driven by a common camshaft 60. The camshaft 60 is rotatably driven by a crankshaft 61 of the engine 51 or the like.

In the ECU 70 as control means, a program and a map or the like are preliminarily memorized and various arithmetic processing are performed based on the signals transmitted from the sensors or the like. An acceleration gate opening sensor 71, a rotating number sensor 72 and a common-rail pressure sensor 73 are connected to the ECU 70 as sensors for detecting an operating condition of a vehicle or the like. The acceleration gate opening sensor 71 detects the acceleration gate opening as a load detecting means. The rotating number sensor 72 detects the engine rotation numbers. The common-rail pressure sensor 73 detects the common-rail pressure. The rotating number sensor 72 also serves as the crank angular velocity detecting means 10 for detecting the crank angular velocity of the engine 51.

A supercharging device (a turbo) 62 is provided in the engine, and a boost sensor 75 for detecting the boost pressure is provided at the passage operatively connected to an intake manifold of the supercharging device 62. An exhaust gas temperature sensor 76 is arranged as an exhaust gas temperature detecting means at the passage operatively connected from an exhaust manifold to the supercharging device 62. A turbo rotating number sensor 74 as a rotating number detecting means of the turbine is provided near the rotating shaft of the turbine in the supercharging device 62. All of the detecting means are connected to the ECU 70.

Referring to FIG. 5, an injection quantity map 80 is preliminarily memorized in the ECU 70, so as to calculate the injection quantity based on the load and the rotation numbers. The injection quantity map 80 is a map that the horizontal scale is represented as the engine rotation number r and the longitudinal scale is represented as the acceleration gate opening A. The injection quantity map 80 is defined in every cylinder. The respective cells of the injection quantity map 80 are continuously formed by the engine rotation numbers r in a given area and the acceleration gate opening A in the given area. The respective cells of the injection quantity map 80 shows an injection quantity Q equivalent to the acceleration gate opening detective by the accelerator sensor 71 and the engine rotation numbers detected by the rotation number sensor 72. The ECU 70 calculates an opening valve time t of the injectors 53 of the respective cylinders according to the common rail pressures detected by the common rail pressure sensor 73 so as to inject the injection quantity Q.

Typically, in the injection quantity map 80 an initial setting is memorized based on the injector 53 at the factory default of the products. In the present embodiment, the injection quantity map 80 is compensated by the following injection quantity compensation control and cylinder difference torque compensation control.

Referring to FIG. 6, an angular velocity amplitude map 90, which shows an assumed angular velocity amplitude $\omega L$ represented by the rotation number and the injection quantity, is preliminarily memorized in the ECU 70. The angular velocity amplitude map 90 is a map that the horizontal scale is represented as the engine rotation number r and the longitudinal scale is represented as the injection quantity Q. The respective cells of the angular velocity amplitude map 90 are continuously formed by the engine rotation number r in a prescribed area and the injection quantity Q in the prescribed area. In other words, the respective cells of the angular velocity amplitude map 90 shows the moderate angular velocity amplitude obtained from the engine rotation number r and the injection quantity Q, i.e. the assumed angular velocity amplitude $\omega L$. The angular velocity amplitude map 90 is based on an adequate value calibrated by a master engine or the like.

FIG. 7 shows a relationship between the crank angle $\theta$ and the crank angular velocity $\omega$ of the four-cycle, four-cylinder diesel engine equipped with the common-rail fuel injection system 50.

Referring to FIG. 7, for example, the present angular velocity $\omega$ (an amplitude $\omega n$ represented in full line of FIG. 7) has a larger amplitude than the assumed angular velocity $\omega$ (an amplitude $\omega L$ represented in dotted line of FIG. 7). In other words, the larger torque than the adequate torque is actually generated. This is, for example, due to the deterioration of the injector 53.

In this case, the injection quantity map 80 is compensated by the injection quantity compensation control as described below so as to calculate the adequate injection quantity.

FIG. 8 shows a brief flow diagram of the injection quantity compensation control.

First, the ECU 70 calculates an adequate angular velocity amplitude $\omega L$ using the angular velocity amplitude map 90 based on the present injection quantity Qn and engine rotation number rn (Step S110). The ECU 70 measures the present angular velocity amplitude $\omega n$ using the rotation number sensor 72 (Step S120).

The ECU 70 calculates a D ($D=\omega n-\omega L$) so as to compare the $\omega L$ with the $\omega n$. Further, the ECU 70 evaluates that the torque generated by the engine largely exceeds the adequate torque if the D is larger than the predetermined value $\omega a$ (Step S140), and compensates the injection quantity map 80 so as to decrease the Q (Step S150).

Meanwhile, the ECU 70 evaluates that the actual torque largely falls below the adequate torque if the D is smaller than the predetermined value $\omega a$ (Step S160), and compensates the injection quantity map 80 so as to increase the Q (Step S170).

In the compensation for the injection quantity map 80 by the above-mentioned injection quantity compensation control (Steps, S150 and S170), the specific compensation method according to the present embodiment is not especially limited. For example, the compensation area includes increasing (or decreasing) the Q in the whole area of the injection quantity map 80, increasing (or decreasing) only the Q in the queue of the rotation number rn that now need to be transcribed, or increasing (or decreasing) only the Q in the block that now need to be transcribed or the like. On the other hand, the compensation method includes increasing (or decreasing) the Q only at the predetermined ratio or increasing (or decreasing) the Q so as to transfer it in the range of one cell or the like.

Accordingly, the actual torque generated by the engine can be calculated by measuring the angular velocity amplitude of the engine rotation and by comparing it with the adequate angular velocity amplitude. The engine without the torque variation can be realized regardless of the interannual deterioration of the device.

FIG. 9 shows a relationship between the crank angle $\theta$ and the crank angular velocity $\omega$ of the four-cycle, four-cylinder diesel engine equipped with the common-rail fuel injection system.

Referring to FIG. 9, for example, the angular velocity $\omega r$ of the first cylinder has a larger amplitude than the angular velocity ωn of the third cylinder. In other words, different torques are generated in between the cylinders. This is due to the variability of the injectors 53 of the respective cylinders.

In this case, the injection quantity map 80 of the respective cylinders is compensated by the cylinder difference torque compensation control as described below so as to realize the homogeneous torque in every cylinder.

FIG. 10 shows a brief flow diagram of the cylinder difference torque compensation control.

First, the ECU 70 determines a standard cylinder (Step S210). The ECU 70 measures the present angular velocity amplitude ωr of the standard cylinder (#r) (Step S220).

Next, the ECU 70 measures the angular velocity amplitude ωn of the cylinder (#n) which needs the compensation (Step S230). The ECU 70 compensates the injection quantity Q of the injection quantity map 80 in the cylinder (#n) which needs the compensation so that it meets the formula of ωr=ωn (Step S240). In the preset embodiment, the compensation for the injection quantity map 80 is not especially limited. Because if the injection quantity Q is increasing, the ωn is increasing and if the injection quantity Q is decreasing, the ωn is decreasing, the compensation may be equal to the above-mentioned injection quantity compensation control.

Incidentally, the ECU 70 performs the processes of S230 and S240 not to the standard cylinder (#r) but to all of the remaining cylinders.

Accordingly, the variability of the torques generated by the respective cylinders can be reduced by conforming the angular velocity amplitude of the standard cylinder to that of the other cylinders, thereby minimizing the vibration by the explosion.

Further, the engine without the interannual deterioration of the injection system in the whole traveling areas, i.e. the performance degradation can be realized by combining the cylinder difference torque compensation control with the above-described injection quantity compensation control.

FIG. 11 shows a brief flow diagram of the injection quantity compensation confirming control of the embodiment according to the present invention.

Referring to FIG. 11, the injection quantity compensation confirming control is a control so as to confirm the reliability of the injection quantity Q compensated using the injection quantity compensation control or the cylinder difference torque compensation control based on an intention of the operator, the boost pressure, the exhaust gas temperature or the turbo rotation numbers.

The ECU 70 confirms to the operator whether the operator will perform the compensation or not after the injection quantity map 80 is compensated by the injection quantity compensation control (S100) or the cylinder difference torque compensation control (S200) (Step S310). If the operator selects to cancel the compensation, the ECU 70 returns the injection quantity map 80 to the default value (Step S380).

The ECU 70 issues a warning to perform the compensation to the operator (Step S320) and conducts the fuel injection based on the compensated injection quantity map 80 (Step S330).

The ECU 70 confirms whether the boost pressure P of the engine that conducted the fuel injection based on the compensated injection quantity map 80 is within the prescribed area (Pa<P<Pb) or not (Step S340). The ECU 70 evaluates that the compensation is normal if the boost pressure P is within the prescribed area. The ECU 70 evaluates that the compensation is abnormal if the boost pressure P is beyond the prescribed area and issues the command to the operator (Step S370).

The ECU 70 confirms whether the exhaust gas temperature T of the engine that conducted the fuel injection based on the compensated injection quantity map 80 is within the prescribed area (Ta<T<Tb) or not (Step S350). The ECU 70 evaluates that the compensation is normal if the exhaust gas temperature T is within the prescribed area. The ECU 70 evaluates that the compensation is abnormal if the exhaust gas temperature T is beyond the prescribed area and issues the command to the operator (Step S370).

The ECU 70 confirms whether the turbo rotation number r of the engine that conducted the fuel injection based on the compensated injection quantity map 80 is within the prescribed area (ra<r<rb) or not (Step S360). The ECU 70 evaluates that the compensation is normal if the turbo rotation number r is within the prescribed area. The ECU 70 evaluates that the compensation is abnormal if the turbo rotation number r is beyond the prescribed area and issues the command to the operator (Step S370).

If the ECU 70 evaluates that the engine is abnormal (Step S370), it returns the injection quantity map 80 to the default value (Step S380).

Incidentally, in the present embodiment, the warning means (S320, S370) are not especially limited as far as the operator can confirm them. The method for returning the injection quantity map to the default value includes returning it to the default value at the factory default or returning it to the default value during the present engine starting or the like. The method is not especially limited in the present embodiment. Not all of S340, S350 and S360 need not to be confirmed and they may be omitted in accordance with the configuration of the engine (for example, the engine without the turbo device) applied to the present embodiment.

Consequently, the operator can evaluates whether the compensation should be performed or not, any time the injection quantity map 80 is compensated, thereby preventing the compensation of the injection quantity without an attempt of the operator. The operator can confirm that the compensation is performed, any time the injection quantity map 80 is compensated, thereby improving the operation performance of the engine.

The ECU 70 measures the exhaust gas temperature, the boost pressure or the turbo rotation numbers of the engine after the compensation of the injection quantity map 80 and evaluates whether they are within the prescribed area, thereby judging whether the engine is in a normal condition or not. Accordingly, the false operation of the engine can be prevented even if the compensation of the injection quantity map 80 is not normally performed due to the false operation of the ECU 70 or the like.

INDUSTRIAL APPLICABILITY

The present invention is available in the common rail diesel engine.

What is claimed is:

1. An engine comprising:

an engine torque detection means including an angular velocity detecting means for detecting a rotation angular velocity of a crankshaft of an engine, wherein the engine torque detection means detects a variability of an angular velocity amplitude obtained by the angular velocity detecting means as the variability of the torque generated by the engine;

a load detecting means for detecting an engine load;

a rotation number detecting means for detecting the engine rotation number;

an injection quantity map for calculating the fuel injection quantity based on the load by the load detecting means and the rotation number by the rotation number detecting means;

an angular velocity amplitude map that represents an assumed angular velocity amplitude that is defined by the rotation number detected by the rotation number detecting means and by the injection quantity calculated using the injection quantity map; and an injection quantity compensation means for compensating the injection quantity map by comparing the angular velocity amplitude detected by the engine torque detection means with the assumed angular velocity amplitude determined using the angular velocity amplitude map.

2. The engine as set forth in claim 1, wherein the angular velocity amplitude is a relative angular velocity amplitude to an average angular velocity or an absolute value of the angular velocity amplitude.

3. The engine as set forth in claim 1, wherein the angular velocity amplitude is only a larger angular velocity amplitude than an average angular velocity.

4. The engine as set forth in claim 1, wherein the angular velocity amplitude is an angular velocity amplitude of the engine rotation toward the angle of the engine rotation, or the angular velocity amplitude of the engine rotation with respect to time.

5. The engine as set forth in claim 1, further comprising:

a cylinder difference torque compensating means including the angular velocity detecting means and the injection maps provided in the respective cylinders, wherein the angular velocity amplitude of one cylinder detects an angular velocity amplitude, and the cylinder difference torque compensating means compensates the injection quantity map or maps of another cylinder or other cylinders so as to conform the angular velocity amplitudes detected by the angular velocity detecting means of the other cylinder or cylinders to the angular velocity amplitude detected by the angular velocity detecting means of the one cylinder.

6. The engine as set forth in claim 1, further comprising:

an exhaust gas temperature detecting means for detecting the exhaust gas temperature, and an injection quantity compensation value confirming means, wherein the injection quantity compensation value confirming means evaluates that the injection quantity map compensated by the injection quantity compensation means is normal if the exhaust gas temperature detected by the exhaust gas temperature detecting means is within the prescribed area, and wherein the injection quantity compensation value confirming means evaluates that the injection quantity map is abnormal if the exhaust gas temperature is beyond the prescribed area.

7. The engine as set forth in claim 5, further comprising:

an exhaust gas temperature detecting means for detecting the exhaust gas temperature, and an injection quantity compensation value confirming means, wherein the injection quantity compensation value confirming means evaluates that the injection quantity map or maps compensated by the cylinder difference torque compensation means is or are normal if the exhaust gas temperature detected by the exhaust gas temperature detecting means is within the prescribed area, and wherein the injection quantity compensation value confirming means evaluates that the injection quantity map or maps is or are abnormal if the exhaust gas temperature is beyond the prescribed area.

8. The engine as set forth in claim 1, further comprising:

a supercharging device;

a supercharging device pressure detecting means for detecting the supercharging device pressure of the supercharging device; and an injection quantity compensation value conforming means, wherein the injection quantity compensation value conforming means evaluates that the injection quantity map compensated by the injection quantity compensation means is normal if the supercharging device pressure detected by the supercharging device pressure detecting means is within the prescribed area, and wherein the injection quantity compensation value confirming means evaluates that the injection quantity map is abnormal if the supercharging device pressure is beyond the prescribed area.

9. The engine as set forth in claim 5, further comprising:

a supercharging device;

a supercharging device pressure detecting means for detecting the supercharging device pressure of the supercharging device; and an injection quantity compensation value conforming means, wherein the injection quantity compensation value conforming means evaluates that the injection quantity map or maps compensated by the cylinder difference torque compensation means is normal if the supercharging device pressure detected by the supercharging device pressure detecting means is within the prescribed area, and wherein the injection quantity compensation value conforming means evaluates that the injection quantity map or maps is or are abnormal if the supercharging device pressure is beyond the prescribed area.

10. The engine as set forth in claim 1, further comprising:

a supercharging device;

a turbo rotation number detecting means for detecting the rotation number of the turbine of the supercharging device; and an injection quantity compensation value conforming means, wherein the injection quantity compensation value conforming means evaluates that the injection quantity map compensated by the injection quantity compensation means is normal if the turbo rotation number detected by the turbo rotation number detecting means is within the prescribed area, and wherein the injection quantity compensation value conforming means evaluates that the injection quantity map is abnormal if the supercharging device pressure is beyond the prescribed area.

11. The engine as set forth in claim 5, further comprising:

a supercharging device;

a turbo rotation number detecting means for detecting the rotation number of the turbine of the supercharging device; and an injection quantity compensation value conforming means, wherein the injection quantity compensation value conforming means evaluates that the injection quantity map compensated by the injection quantity compensation means or by the cylinder difference torque compensation means is normal if the turbo rotation number detected by the turbo rotation number detecting means is within the prescribed area, and wherein the injection quantity compensation value conforming means evaluates that the injection quantity map is abnormal if the supercharging device pressure is beyond the prescribed area.

12. The engine as set forth in claim 1, further comprising:

a warning means, wherein the warning means issues a warning to an operator if the injection quantity map or maps is or are compensated by the injection quantity compensation means.

13. The engine as set forth in claim 5, further comprising:

a warning means, wherein the warning means issues a warning to an operator if the injection quantity map or maps is or are compensated by the injection quantity compensation means.

14. The engine as set forth in claim 6, further comprising:

a warning means, wherein the warning means issues a warning to an operator if the injection quantity compensation value conforming means evaluates that the injection quantity map is abnormal.

15. The engine as set forth in claim 7, further comprising:

a warning means, wherein the warning means issues a warning to an operator if the injection quantity compensation value conforming means evaluates that the injection quantity map is abnormal.

16. The engine as set forth in claim 1, further comprising:

a compensation canceling means manipulated by an operator so as to cancel the injection quantity compensation means.

17. The engine as set forth in claim 5, further comprising:

a compensation canceling means manipulated by an operator so as to cancel the compensation of the injection quantity map by the cylinder difference torque compensation means.

18. The engine as set forth in claims 8, further comprising:

a warning means, wherein the warning means issues a warning to an operator if the injection quantity compensation value conforming means evaluates that the injection quantity map is abnormal.

19. The engine as set forth in claims 9, further comprising:

a warning means, wherein the warning means issues a warning to an operator if the injection quantity compensation value conforming means evaluates that the injection quantity map is abnormal.

20. The engine as set forth in claims 10, further comprising:

a warning means, wherein the warning means issues a warning to an operator if the injection quantity compensation value conforming means evaluates that the injection quantity map is abnormal.

21. The engine as set forth in claims 11, further comprising:

a warning means, wherein the warning means issues a warning to an operator if the injection quantity compensation value conforming means evaluates that the injection quantity map is abnormal.

* * * * *